US011623362B2

(12) United States Patent
Bramley et al.

(10) Patent No.: US 11,623,362 B2
(45) Date of Patent: Apr. 11, 2023

(54) CUTTING FLUID DELIVERY CONTROLLER FOR A SAWMILL, AND METHODS AND SYSTEMS FOR CONTROLLING DELIVERY OF CUTTING FLUID IN A SAWMILL

(71) Applicant: Woodland Mills Inc., Port Perry (CA)

(72) Inventors: Neil K. Bramley, Port Perry (CA); Joshua J. Malcolm, Port Perry (CA); Jeffrey F. Doherty, Peterborough (CA)

(73) Assignee: Woodland Mills Inc., Port Perry (CA)

( * ) Notice: Subject to any disclaimer, the term of this patent is extended or adjusted under 35 U.S.C. 154(b) by 0 days.

(21) Appl. No.: 16/858,382

(22) Filed: Apr. 24, 2020

(65) Prior Publication Data

US 2020/0353640 A1 Nov. 12, 2020

(30) Foreign Application Priority Data

Apr. 26, 2019 (CA) ..... 3041479
Apr. 23, 2020 (CA) ..... 3079275

(51) Int. Cl.
*B27B 13/16* (2006.01)
*B27B 13/12* (2006.01)

(52) U.S. Cl.
CPC ..... *B27B 13/16* (2013.01); *B27B 13/12* (2013.01)

(58) Field of Classification Search
CPC ..... B27B 13/16; B27B 13/12; B27B 15/00; Y10T 83/263; Y10T 83/0443; Y10T 83/0453; Y10T 83/2066; Y10T 83/2068; Y10T 83/707; Y10T 83/7183; Y10T 83/7189; Y10T 83/7195; Y10T 83/7201; Y10T 83/7208; Y10T 83/7214; Y10T 83/722; Y10T 83/7226; Y10T 83/9317
USPC ..... 451/101, 167, 168, 449, 450
See application file for complete search history.

(56) References Cited

U.S. PATENT DOCUMENTS 2,746,495 A * 5/1956 Greenlaw ..... B23D 59/04 83/13
2,838,825 A * 6/1958 Knollenberg ..... B23Q 3/16 83/386
3,097,675 A * 7/1963 Benedict ..... B23D 59/04 83/169
3,188,010 A * 6/1965 James ..... B23D 59/02 239/412
4,275,632 A 6/1981 Ross
6,000,387 A * 12/1999 Lee ..... B23D 47/025 125/11.22
7,784,387 B2 8/2010 Dale
(Continued)

*Primary Examiner* — Phong H Nguyen
(74) *Attorney, Agent, or Firm* — Fox Rothschild LLP

(57) ABSTRACT

A cutting fluid delivery controller for a sawmill, and methods and systems for controlling delivery of cutting fluid to a saw blade in a sawmill. The saw blade is driven by a motor. The speed of the motor is regulated by a throttle lever having an idle speed position and a cutting speed position. The cutting fluid delivery controller includes a fluid valve configured to automatically turn on a flow of cutting fluid to the saw blade when the throttle lever is set to the cutting speed position, and to automatically turn off the flow of the cutting fluid when the throttle lever is set to the idle speed position. The cutting fluid delivery controller interconnects the fluid valve and the throttle lever to allow the operator to simultaneously control operation of the saw blade, and the flow of the cutting fluid to the saw blade, with a single operator manipulable actuator.

35 Claims, 9 Drawing Sheets

(56) References Cited

U.S. PATENT DOCUMENTS

| | | | | |
|---|---|---|---|---|
| 8,215,216 | B2 | 7/2012 | Dale | |
| 2005/0081690 | A1* | 4/2005 | Biro | B23D 59/006 83/168 |
| 2009/0255390 | A1* | 10/2009 | Chaffin | B26D 7/088 83/168 |

* cited by examiner

CUTTING FLUID DELIVERY CONTROLLER FOR A SAWMILL, AND METHODS AND SYSTEMS FOR CONTROLLING DELIVERY OF CUTTING FLUID IN A SAWMILL

FIELD OF THE INVENTION

The present invention relates generally to the field of sawmills. More particularly, the present invention relates to a cutting fluid delivery controller for a portable sawmill having a cutting blade, and methods and systems for controlling delivery of cutting fluid to a saw blade in a portable sawmill.

BACKGROUND OF THE INVENTION

A sawmill typically includes three main components, namely, a bed, a carriage, and a saw head. The bed is adapted to support a log extending horizontally along the bed. The carriage is mounted to the bed for horizontal movement along the length of the log, and the saw head is mounted to vertical posts on the carriage. The vertical posts of the carriage permit vertical movement of the saw head relative to the carriage, and the carriage is adapted for horizontal movement along the bed. The saw head typically includes a band saw blade to cut the log as the carriage is moved horizontally along the bed. U.S. Pat. No. 4,275,632 to Ross, and U.S. Pat. No. 7,784,387 to Dale disclose examples of such a sawmill.

It is known to employ systems which cool and lubricate the saw blade with a cutting fluid. The cutting fluid washes away swarf and keeps the saw blade cool and lubricated. The cutting fluid preferably serves as a liquid coolant to reduce or regulate the temperature of the saw blade, by removing heat generated by friction between the surfaces of the saw blade and the workpiece material, and by reducing friction between the surfaces of the saw blade and the workpiece material. Preferred cutting fluids have high thermal capacity, low viscosity, are low-cost, non-toxic, chemically inert, and neither cause nor promote corrosion of the saw blade or other components of the sawmill. In some applications, it may also be preferable for the cutting fluid to be an electrical insulator.

It has been found that sawmills work better when the saw blade is kept cool and lubricated with a cutting fluid. The cutting fluid helps keep the saw blade pitch-free, improves cutting performance, and extends the life of the saw blade.

There are various kinds of cutting fluids, which include oils, oil-water emulsions, pastes, gels, aerosols (mists), and air or other gases. They may be made from petroleum distillates, animal fats, plant oils, water and air, or other raw ingredients. Depending on context and on which type of cutting fluid is being considered, it may be referred to as cutting fluid, cutting oil, cutting compound, coolant, or lubricant.

In the case of portable sawmills, the cutting fluid is often water, and the source may be, for example, a public utility supplying the water via a water tap, or a reservoir tank supplying the water by gravity feed.

The flow of the cutting fluid from the source to the saw blade may be regulated by a simple on/off valve, separate from the throttle control which is used to regulate the operating speed of the sawmill's motor. When the simple on/off valve is in the on position, cutting fluid is discharged on the saw blade at a maximum rate, which is suitable for operating the saw blade at normal cutting speed, but is wasteful when the saw blade is stopped, or being operated at below normal cutting speed. On the other hand, the saw blade can be damaged or worn prematurely when the simple on/off valve is inadvertently left off while the saw blade is being operated at the normal cutting speed to cut the workpiece material.

In conventional sawmills equipped with a saw blade lubrication system having a simple on/off valve such as the one described above, the operator turns on the valve before use, which, in turn, releases the cutting fluid onto the saw blade. In order to conserve cutting fluid and minimize a muddy or wet cutting environment, it is common for the operator to turn the valve off after completing a cut through the log. The operator will keep the valve off as he adjusts the sawmill for the next cut, and then turn the valve on immediately before starting the next cut. These additional steps of turning the valve off and on between cuts through the log increases the amount of effort and time required by the operator to complete the log cutting task.

Attempts have been made in the prior art to address the problems described above in relation to known ways of regulating the flow of the cutting fluid from the source to the saw blade.

U.S. Pat. No. 8,215,216 to Dale is one example of a blade lubrication system for a sawmill having a blade, chain or band saw, and a control mechanism for activating the blade, chain or band. The blade lubrication system automatically activates cooling and cleaning of the blade, or band when the control mechanism is activated, and automatically deactivates the cooling and cleaning of the blade, chain or band when the control mechanism is deactivated. The blade lubrication system uses a plurality of Bowden cables to allow an operator to simultaneously regulate a saw throttle and a blade lubrication controller. The blade lubrication controller is a simple, commercially available slam latch, having a pull and bolt. The bolt is spring biassed in an outwards direction to clamp closed a malleable, elastic or flexible hose used to deliver blade lubricant from a reservoir to the saw blade, by applying pressure to the external surface of the hose. Pulling on the pull withdraws the bolt inwards to unclamp the hose, thereby allowing the blade lubricant to flow from the reservoir through the hose to contact the blade when it emerges from the end of the hose. The throttle control is connected to the pull by a blade lubrication inner cable. The throttle control is also connected to a saw throttle by a separate throttle inner cable. In this way, the blade lubrication system is triggered in conjunction with the triggering of the saw throttle, such that the blade is lubricated only when the throttle is on and the blade is cutting a log.

A problem with the Dale system is that it relies on multiple cables to operate the saw throttle and the blade lubrication system, increasing material costs, and labour costs associated with adjusting the cables. Another problem with the Dale system is that over time, the slam latch will wear down and damage the lubrication hose, causing it to leak. The risk of damage to the lubrication hose may be elevated in cold weather conditions, since the lubrication hose will be more brittle, and less flexible when it is cold. Yet another problem with the Dale system is that over time, the lubrication hose will not return to a fully open position when the bolt of the slam latch is withdrawn, resulting in a reduction in the maximum flow of blade lubricant from the reservoir to the blade.

As a potential solution to the problems associated with the Dale system, Wood-mizer LLC, of Indianapolis, Ind., U.S.A., manufactures sawmills including saw blade lubrication systems that use a solenoid valve to turn the flow of water to the saw blade on and off. The solenoid valve is positioned in a hose between a water reservoir and the saw blade. The solenoid valve is energized by electrical power, causing it to open to allow water to flow on to the saw blade, when the operator squeezes a handle of a throttle control to increase the speed of the motor to drive the saw blade to a normal cutting speed. The solenoid valve is energized by an alternator driven by the motor. The solenoid valve either gradually opens as the charge requirement is met, or the solenoid valve opens completely only after the charge requirement is met (i.e. 12 volts). When the operator releases the handle to bring the speed of the motor down to an idle speed, thereby stopping the saw blade, the solenoid valve is de-energized, causing the solenoid valve to close to block water from flowing on to the saw blade.

However, a problem with the Wood-mizer saw blade lubrication system, and others of its type which rely on a solenoid valve to regulate the flow of cutting fluid, is that it requires a source of electrical power to operate. Typically, sawmills with smaller motors do not have a source of electrical power sufficient to actuate a solenoid valve. In particular, the sawmill may not come equipped with any source of electrical power, or the source of electrical power may not be sufficient to actuate the needed solenoid valve. Other problems with saw blade lubrication systems that utilize solenoid valves are the added manufacturing costs associated with the solenoid valves, and the added risks of component failure associated with electrical components such as solenoid valves, as compared to their mechanical counterparts.

Accordingly, there is a continuing need for improvements in sawmills.

SUMMARY OF THE INVENTION

What is desired therefore, is a sawmill which overcomes at least some of the problems associated with the prior art.

According to a preferred embodiment of the present invention, there is disclosed a cutting fluid delivery system for a sawmill, and a sawmill incorporating the same. Preferably, the sawmill may have a saw blade driven by a motor, such as, for example, an internal combustion engine. The speed of the motor is preferably regulated by a throttle assembly having an idle speed position and a cutting speed position. The cutting fluid delivery system includes a cutting fluid delivery controller having a valve assembly configured to automatically turn on a flow of the cutting fluid to the saw blade when the throttle assembly is set to the cutting speed position, and to automatically turn off the flow of the cutting fluid when the throttle assembly is set to the idle speed position. Preferably, the cutting fluid delivery controller interconnects the valve assembly and the throttle assembly to allow the operator to simultaneously control operation of the saw blade, and the flow of cutting fluid to the saw blade, with a single operator manipulable actuator.

Therefore, according to one aspect of the present invention, there is disclosed a cutting fluid delivery controller for controlling a flow of a cutting fluid from a cutting fluid reservoir to a saw blade in a sawmill, said sawmill being of the type having a motor for driving the saw blade, and a throttle lever for regulating an operating speed of the motor, the throttle lever being movable between an idle speed position and a cutting speed position, said controller comprising:

a fluid valve having an inlet for receiving said cutting fluid, an outlet for discharging said cutting fluid for application to said saw blade, a fluid flow path between said inlet and said outlet, and a valve actuator having a first position which causes said fluid valve to block said fluid flow path, and a second position which causes said fluid valve to unblock said fluid flow path; and a frame member for holding said fluid valve, said frame member having an attachment member for attaching said frame member to said sawmill;

wherein when said cutting fluid delivery controller is operably attached to said sawmill, said valve actuator is directly, or indirectly moved from said first position to said second position by said throttle lever, when said throttle lever is moved to said cutting speed position, causing said fluid valve to allow said cutting fluid to flow from said inlet to said outlet toward said saw blade, and said valve actuator is moved back to said first position when said throttle lever is moved away from said cutting speed position, causing said fluid valve to prevent said cutting fluid from flowing from said inlet to said outlet toward said saw blade.

According to another aspect of the present invention, there is disclosed a sawmill comprising the cutting fluid delivery controller mentioned above.

According to yet another aspect of the present invention, there is disclosed a throttle assembly for a sawmill, said throttle assembly comprising the cutting fluid delivery controller mentioned above.

According to yet another aspect of the present invention, there is disclosed a use of the cutting fluid delivery controller mentioned above, in a sawmill to control said flow of said cutting fluid from said cutting fluid reservoir to said saw blade.

According to yet another aspect of the present invention, there is disclosed a method of controlling delivery of cutting fluid to a saw blade in a sawmill, said sawmill being of the type having a motor for driving the saw blade, and a throttle lever for regulating an operating speed of the motor, the lever being movable between an idle speed position and a cutting speed position, said method comprising the step of:

moving a valve actuator of a fluid valve directly, or indirectly with said throttle lever by moving said throttle lever to said cutting speed position, said fluid valve having an inlet for receiving said cutting fluid, an outlet for discharging said cutting fluid for application to said saw blade, and a fluid flow path between said inlet and said outlet;

wherein said valve actuator has a first position which causes said fluid valve to block said fluid flow path, and a second position which causes said fluid valve to unblock said fluid flow path; and wherein said unblocking said fluid flow path allows said cutting fluid to flow from said inlet to said outlet toward said saw blade, and said blocking said fluid flow path prevents said cutting fluid to flow from said inlet to said outlet toward said saw blade.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein.

Figure 1:
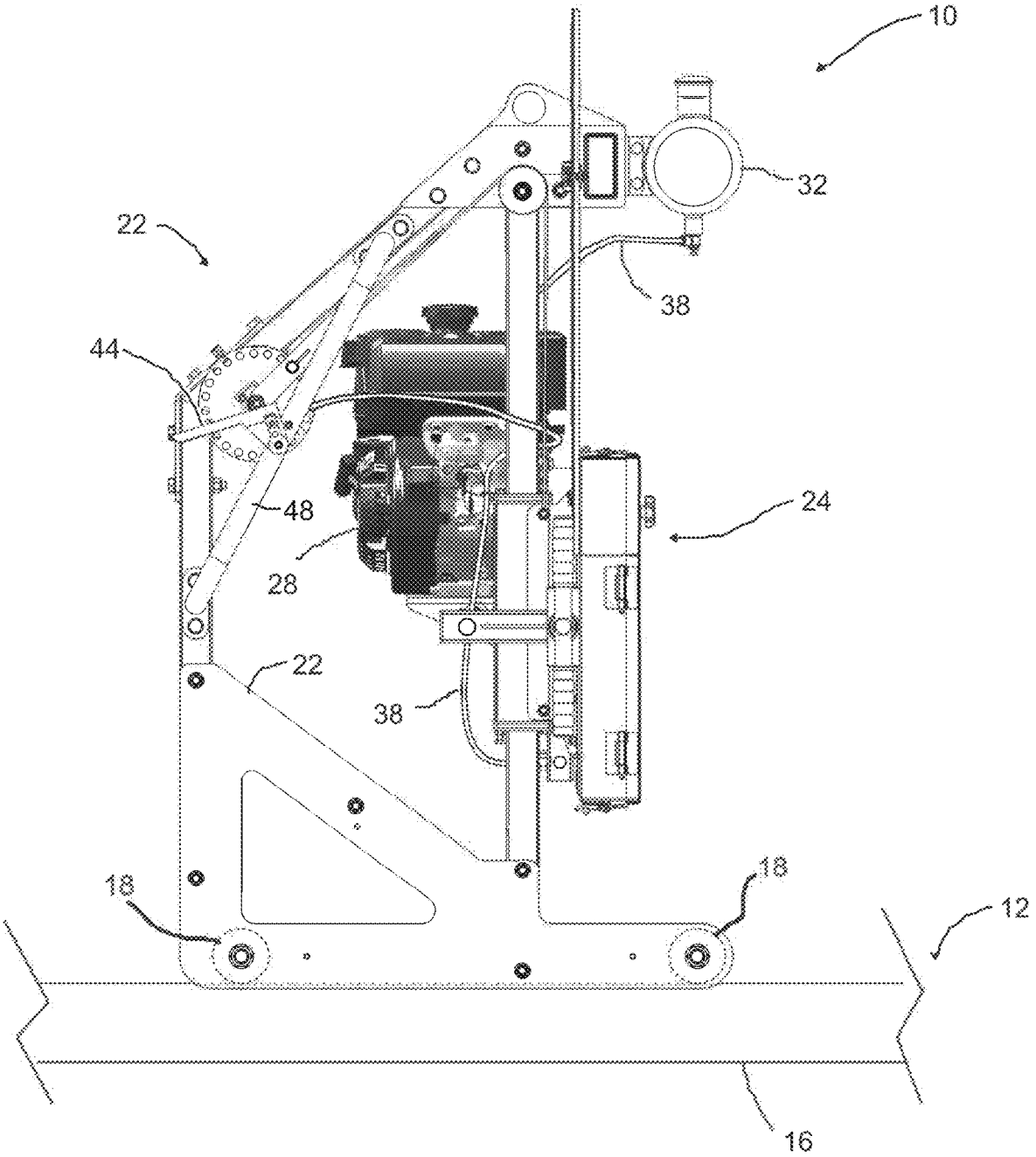
FIG. 1 is a side view of a sawmill incorporating a cutting fluid delivery system, including a cutting fluid delivery controller, according to an embodiment of the present invention.

A sawmill 10 according to an embodiment of the present invention is shown in FIG. 1. As shown, the sawmill 10 includes a bed 12 and a carriage 14. The bed 12 has a pair of substantially parallel rails 16, and the carriage 14 is movably supported along the rails 16, on wheels 18 as shown. By way of example, the workpiece material (not shown) may be made from wood, such as a log (not shown).

With continued reference to FIG. 1, the carriage 14 has a frame 22 that straddles the bed 12, and is moveably supported along the rails 16 on the wheels 18. Preferably, the frame 22 is configured to carry a saw head 24 attached or mounted thereto. Preferably, the saw head 24 includes a band saw, having a blade 26 adapted to cut the workpiece material, a motor 28, such as for example an internal combustion engine, to drive the band saw, and other components that may be necessary or desirable to operate and control the band saw, including a throttle assembly 30, associated with the motor 28. By way of example only, the motor 28 may be an internal combustion engine, such as a Kohler® 7 HP (CH270), a Kohler® 9.5 HP (CH395), a Kohler® 14 HP (CH440), and the like.

Although, the preferred saw head 24 includes a band saw, it is contemplated that the band saw may be replaced with another known type of saw. By way of example only, such other known types of saws may include a chain saw, a reciprocating saw, a circular saw, and the like. All such embodiments are comprehended by the present invention.

Figure 2:
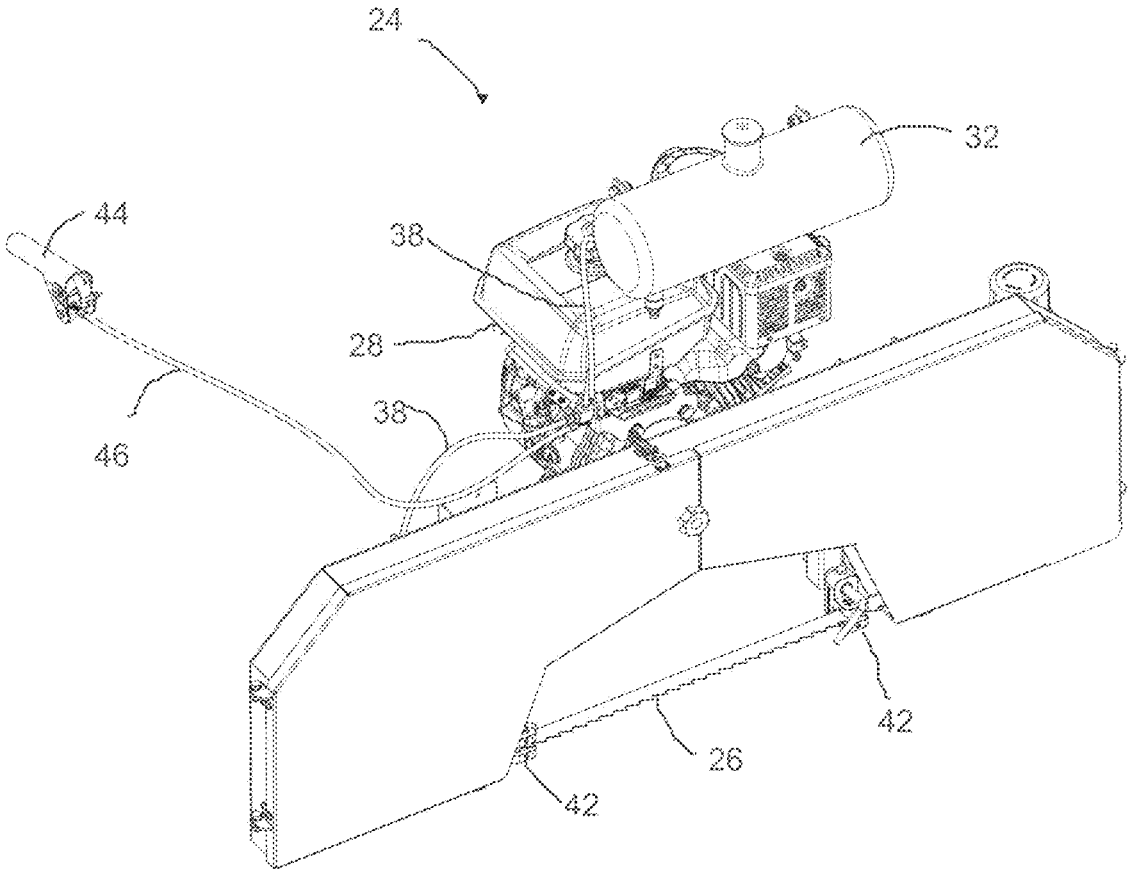
FIG. 2 is a perspective view showing the cutting fluid delivery system, including the cutting fluid delivery controller, arranged in relation to a saw head portion of the sawmill of FIG. 1.
Figure 3:
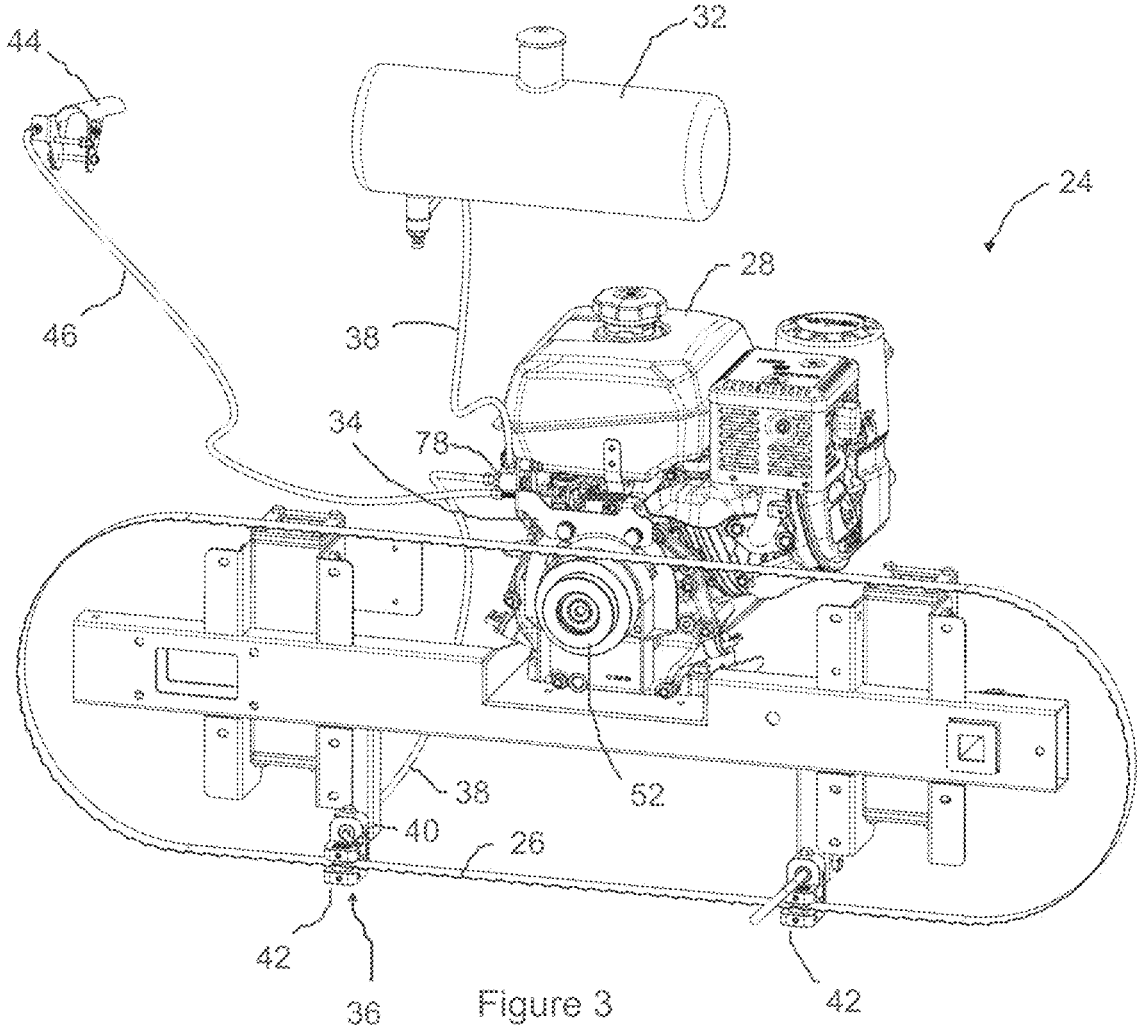
FIG. 3 is a front view of the saw head portion of FIG. 2 with components, including the band saw covers and saw blade pulleys removed, for illustrative purposes.

With reference now to FIGS. 2 and 3, the sawmill 10 also includes a cutting fluid delivery system configured to deliver cutting fluid to the blade 26 when the throttle assembly 30 of the motor 28 is set to a cutting speed, but not when the throttle assembly 30 of the motor 28 is set to an idle speed.

While good results have been obtained using water as the cutting fluid, there are various other known kinds of cutting fluids which may be used, such as, oils, oil-water emulsions, and the like. They may be made from petroleum distillates, animal fats, plant oils, water and air, or other raw ingredients. All such embodiments are comprehended by the present invention.

Preferably, the cutting fluid delivery system includes a cutting fluid reservoir 32, a cutting fluid delivery controller 34, a cutting fluid discharge outlet 36, and conduits 38 operatively connected together to provide a pathway for the cutting fluid from the cutting fluid reservoir 32, through the cutting fluid delivery controller 34 to the cutting fluid discharge outlet 36, and out onto the saw blade 26. Preferably, the cutting fluid discharge outlet 36 may include a cutting fluid applicator in the form of a spout 40 extending from a blade guide 42, and aimed so as to deliver the cutting fluid onto the blade 26.

Preferably, the cutting fluid reservoir 32 may be a container sized and shaped to hold a sufficient amount of cutting fluid to last through 4 to 8 hours of cutting, depending on the flow rate of the cutting fluid to the blade 26. Good results have been obtained by sizing and shaping the cutting fluid reservoir 32 to hold 3 to 13 litres of liquid cutting fluid. As another example, the cutting fluid reservoir 32 may be a public utility supplying water via a water tap, for example.

The conduits 38 are preferably flexible polyurethane, rubber, or rubber-like hoses, which are compatible with the cutting fluid, having an inside diameter of ¼ inch. What is important is that the cutting fluid pathway, including the conduits 38, the cutting fluid discharge outlet 36, and the spout 40 are sized to allow a desirable flow rate for the cutting fluid therethrough by gravity flow.

Preferably, the cutting fluid reservoir 32 may be mounted to the top of the frame 22, at a height above the height of the cutting fluid discharge outlet 36, to ensure that the cutting fluid flows out of the cutting fluid discharge outlet 36 by gravity flow, when the operator engages an operator manipulable actuator 44.

However, it is also contemplated that in other embodiments of the present invention, the cutting fluid reservoir 32 may be omitted and replaced with a direct or indirect connection of a source of cutting fluid, such as a water tap, to the cutting fluid delivery controller 34. As above, it will be important to ensure that the cutting fluid pathway, including the conduits 38, the cutting fluid discharge outlet 36, and the spout 40 are sized to allow a desirable flow rate for the cutting fluid by gravity flow, or by pressure flow, as the case may be. An operator adjustable restriction valve may also be included in the cutting fluid pathway to help regulate the flow rate.

Preferably, the flow rate from the spout 40 may be adjustable by the user to enable him or her to set the flow rate of between about 0.091 litres/minute (i.e. a fast drip), and about 0.272 litres/min (i.e. a stream), inclusive. Most preferably, the user may set the flow rate to the fast drip of about 0.091 litres/min.

The cutting fluid delivery controller 34 may preferably be connected to the operator manipulable actuator 44 by a throttle link 46, such as for example, a Bowden cable, and mounted to a handle 48 attached to the side of the frame 22 for easy access, as shown in FIG. 1. By way of example only, the operator manipulable actuator 44 may be a simple lever arm sized and shaped to be engaged by being pushed to, and held against the handle 48 with the operator's hand, and being biassed to return to a disengaged position when released by the operator.

As best seen in FIG. 3, the cutting fluid delivery controller 34 is preferably mounted to the motor 28. With reference now to FIGS. 4 to 7, the cutting fluid delivery controller 34 is preferably mounted to the motor 28 in relation to the throttle assembly 30.

Figure 4:
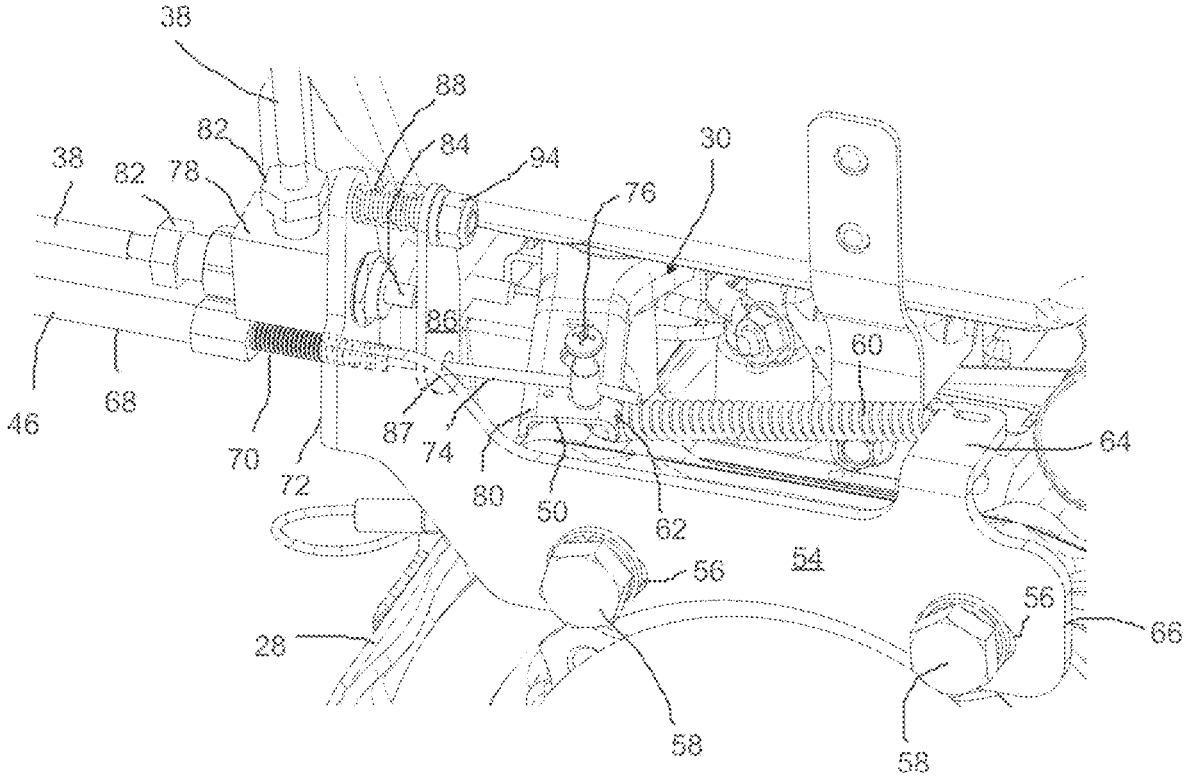
FIG. 4 is an enlarged perspective view of the cutting fluid delivery controller of FIG. 1, in a throttle idle/lubrication off position.
Figure 5:
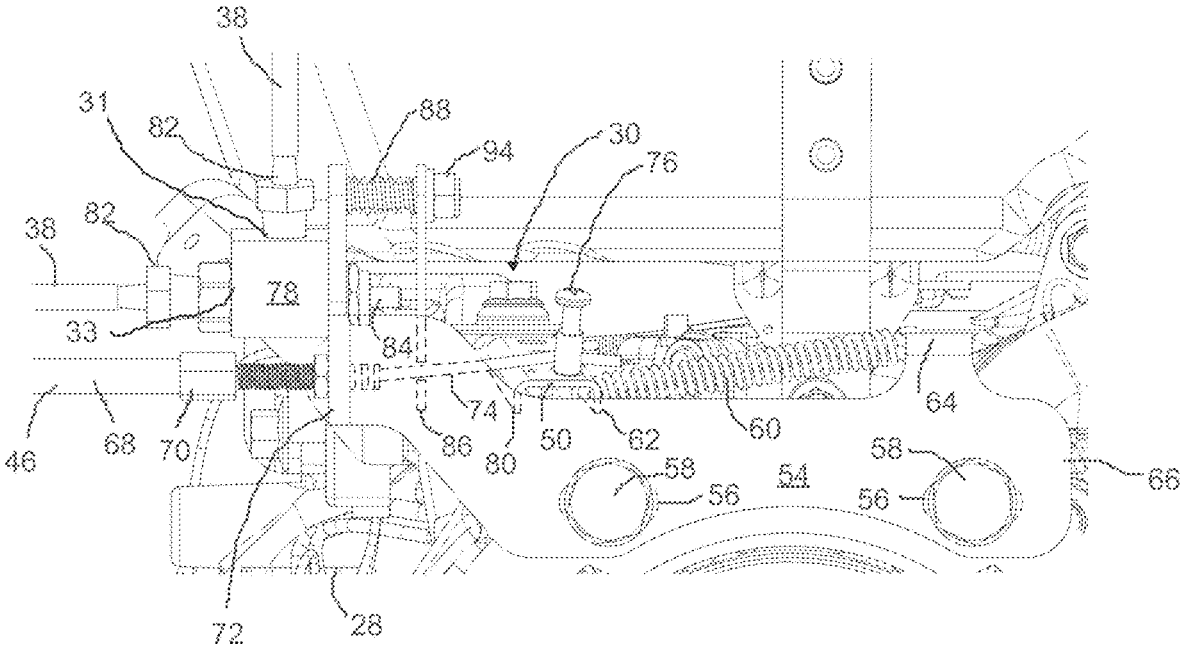
FIG. 5 is a front view of the cutting fluid delivery controller of FIG. 4.

FIGS. 4 and 5 show two views of the cutting fluid delivery controller 34 mounted to the motor 28, in relation to the throttle assembly 30 with its throttle lever 50 set to an idle speed position. As will be appreciated, with the throttle lever 50 set to an idle speed position, the motor 28 will receive a fuel mixture sufficient to operate at an idle speed of about 1800 rpm, which is too slow to engage a centrifugal clutch 52 attached to the drive shaft of the motor 28 and drive the blade 26. Accordingly, when the motor 28 is operating at the idle speed, the blade 26 will not spin, and the sawmill 10 will not cut the workpiece material. The operator will typically leave the sawmill 10 with the motor 28 operating at the idle speed during the time needed to adjust the height of the saw head 24 between cuts.

As can be seen, the cutting fluid delivery controller 34 preferably includes a frame member, such as for example the bracket 54 shown comprising a pair of apertures 56 sized and shaped to allow a pair of threaded fasteners 58 to secure the bracket 54 to matching threaded bores (not shown) in the motor 28. Preferably, the pair of apertures 56 are slot, or oval shaped to allow the bracket 54 to be adjusted left or right before being secured by tightening of the threaded fasteners 58. By way of example only, good results have been obtained by using M10 hex bolts for fasteners 58.

One end of a resiliently biassing member, such as a spring 60, may preferably be attached to the throttle lever 50, and the other end of the spring 60 may be attached to the bracket 54 on one side 62 of the throttle lever 50 so as to bias the throttle lever 50 to its idle speed position. Preferably, the bracket 54 may include a flange 64 positioned at one end 66 of the bracket 54 to provide an attachment point for the other end of the spring 60.

Preferably, the throttle lever 50 is also operably attached to the operator manipulable actuator 44 via the throttle link 46, as mentioned above. As shown, throttle link 46 may preferably include a Bowden cable having its outer sheath 68 terminating in an adjustable guide such as for example a cable thimble 70 adjustably mounted to the other end 72 of the bracket 54. Preferably, the cable thimble 70 may be threadingly carried by a threaded bore in the bracket 54. In this way, turning the cable thimble 70 one way adjusts the cable thimble 70 in one of a first direction away from the threaded bore, and a second direction toward the threaded bore, and turning the cable thimble 70 the other way adjusts the cable thimble in the other of the first direction and the second direction.

The inner cable 74 of the Bowden cable is adjustably secured to throttle lever 50 with a set screw 76. In this way, when the operator engages the manipulable actuator 44, the inner cable 74 withdraws and pulls the throttle lever 50 towards the other end 72 of the bracket 54, into its cutting speed position, against the bias of spring 60. When the operator disengages the manipulable actuator 44, spring 60 pulls the throttle lever 50 towards the one end 66 of the bracket 54, into its idle speed position, thereby extending the inner cable 74 from the outer sheath 68.

Although, including the adjustable guide for the throttle link 46 is preferred, it is contemplated that other embodiments may omit the adjustable guide and instead include a simple passageway in the bracket 54, for the throttle link 46 to pass through to the throttle lever 50. An aperture, a channel, a groove, a C-shaped opening, and the like are examples of such passageways. All such embodiments of the present invention are comprehended by the present invention.

Preferably, a valve assembly 78 is also attached to the other end 72 of the bracket 54, on the other side 80 of the throttle lever 50. A preferred valve assembly 78 is a MJV-2 normally-closed stem valve (available from Clippard Instrument Laboratory, Inc., Cincinnati, Ohio, U.S.A.) having a pair of ⅛ inch NPT, ¼ inch barbed hose fittings 82 attached to its ⅛ inch NPT inlet and outlet connectors 81, 83. One barbed hose fitting 82 is connected to the conduit 38 from the cutting fluid reservoir 32, while the second barbed hose fitting 82 is connected to the conduit 38 to the cutting fluid discharge outlet 36. Preferably, the valve assembly 78 may have a depressable valve actuator, such as for example a stem 84. When stem 84 is depressed to a depressed position, the cutting fluid is able to pass through the valve assembly 78 via a fluid flow path between the inlet 81 and the outlet 83 (i.e. the valve assembly 78 is open, or unblocked), and when the stem 84 of the valve assembly 78 is released, it is preferably biassed to an extended position, in which the cutting fluid is prevented from passing through the valve assembly 78 via the fluid flow path between the inlet 81 and the outlet 83 (i.e. the valve assembly 78 is closed, or blocked).

The valve assembly 78 is preferably attached to the other end 72 of the bracket 54 so that the stem 84 is oriented to extend generally towards the throttle lever 50, and a valve actuation tab 86 may be positioned between the stem 84 and the other side 80 of the throttle lever 50. When present, the valve actuation tab 86 may be resiliently attached to a post in the form of an M6×30 flat head screw 90, with a compression spring 88, a M6 washer 92, and a M6 lock nut 94, in the path of the throttle lever 50, to allow the valve actuation tab 86 to be deflected from its initial position, towards the stem 84, when struck by the throttle lever 50, as will be explained in more detail below. Preferably, the flat head screw 90 may be positioned at a height above the stem 84, and parallel to the stem 84, so that the valve actuation tab 86 may hang downwardly from the flat head screw 90 to a height below the stem 84.

Mounting of the valve actuation tab 86 resiliently in this manner, using a compression spring 88 or the like is preferred because it allows the valve actuation tab 86 to pivot in two axes (i.e. a vertical axis, and a horizontal axis), as well as translocate, relative to the flat head screw 90, to better engage with the other side 80 of the throttle lever 50. However, it is contemplated that in other embodiments of the present invention, the valve actuation tab 86 may be mounted to permit free pivoting in only one axis, or to permit only translocation along one axis, whether in a resilient or non-resilient manner, so long as, the valve actuation tab 86 will still function as an intervening member to allow a pushing force to be transferred from the throttle lever 50 to the stem 84, to cause the stem 84 to depress when the throttle lever 50 is pulled into the cutting speed position. Most preferably, the throttle lever 50 may be pivotally and/or slidably movable between the idle speed position and the cutting speed position. All such embodiments are comprehended by the present invention.

Preferably, the valve actuation tab 86 may include a passageway, such as for example an aperture 87 (or a channel, a groove, a c-shaped opening, etc.) to allow the inner cable 74 to pass through the valve actuation tab 86 to the throttle lever 50, without interfering with the valve actuation tab 86. Good results have been obtained by aligning the aperture 87 (or other passageway in the valve actuation tab 86) with the cable thimble 70 (or other passageway in the bracket 54), to allow the inner cable 74 to pass on through to the throttle lever 50.

It will now be understood that FIGS. 4 and 5 show that when the operator manipulable actuator 44 is disengaged, throttle lever 50 is biassed to the idle speed position by spring 60. Additionally, it will be understood that when in the idle speed position, the throttle lever 50 fails to deflect the valve actuation tab 86 from its normally biassed position, allowing the stem 84 to remain released, thereby preventing flow of cutting fluid through the valve assembly 78 to the blade 26.

Figure 6:
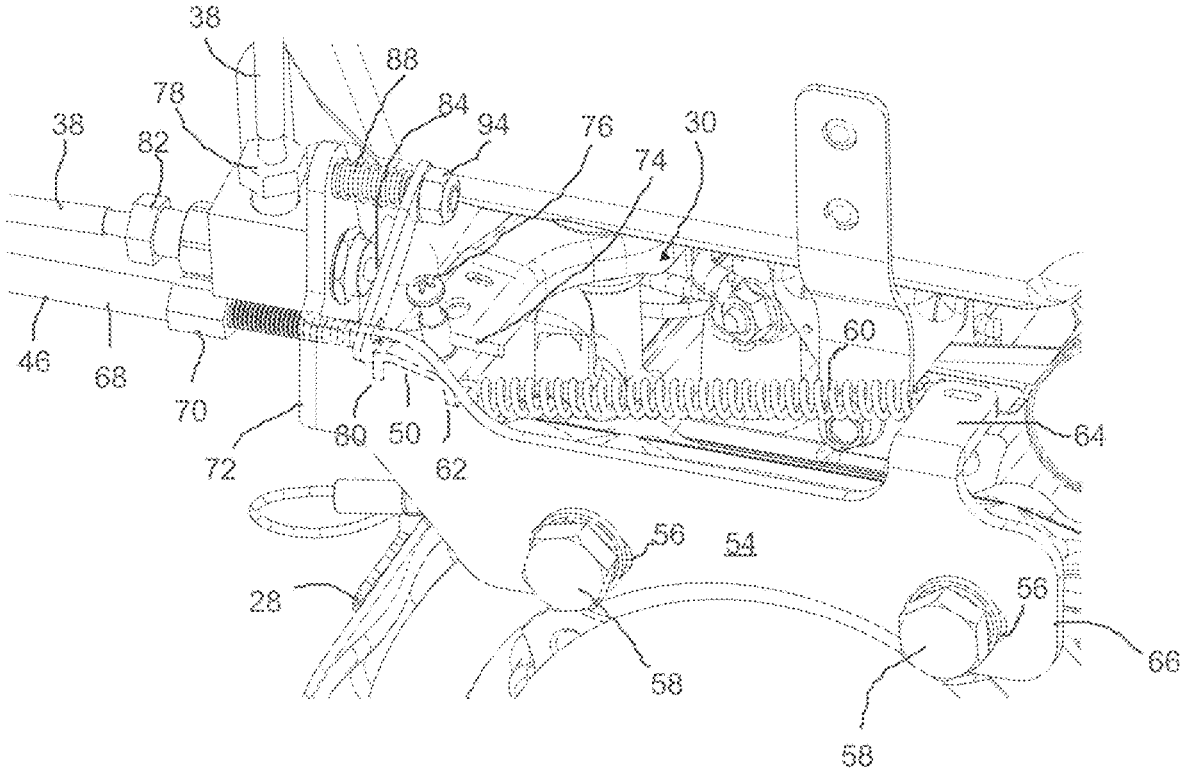
FIG. 6 is an enlarged perspective view of the cutting fluid delivery controller of FIG. 1, in a full throttle/lubrication on position.
Figure 7:
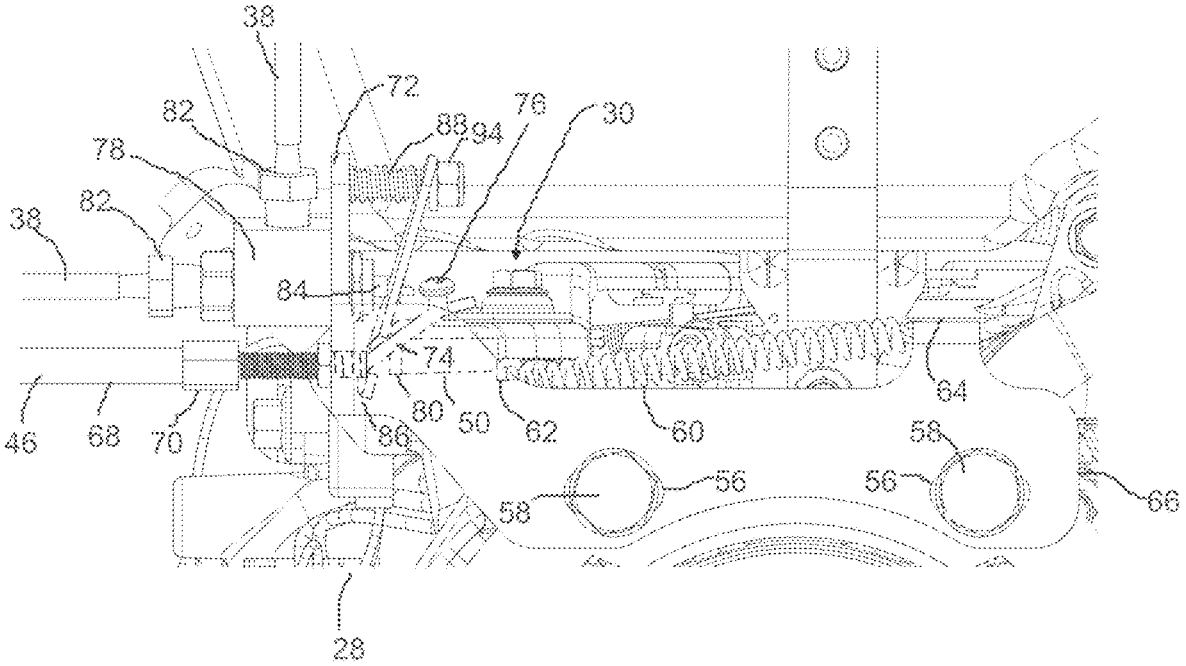
FIG. 7 is a front view of the cutting fluid delivery controller of FIG. 6.

With reference now to FIGS. 6 and 7, there are shown two views of the cutting fluid delivery controller 34 mounted to the motor 28, in relation to the throttle assembly 30 with its throttle lever 50 set to the cutting speed position. As will be appreciated, with the throttle lever 50 set to the cutting speed position, the motor 28 will receive a fuel mixture sufficient to operate at cutting speed of about 3750 rpm (i.e. full throttle), which is fast enough to engage the centrifugal clutch 52 attached to the drive shaft of the motor 28 and drive the blade 26. Accordingly, when the motor 28 is operating at the cutting speed, the blade 26 will spin, and the sawmill 10 will cut the workpiece material. The operator will typically leave the sawmill 10 with the motor 28 operating at the cutting speed during the time needed to make a cut through the workpiece material.

In contrast to FIGS. 4 and 5, FIGS. 6 and 7 show the throttle lever 50 being pulled by inner cable 74 into its cutting speed position, causing spring 60 to stretch. Moreover, it can be seen that when the throttle lever 50 is being pulled toward the cutting speed position, the path of the throttle lever 50 intersects with the valve actuation tab 86 causing it to contact the valve actuation tab 86, and deflect the valve actuation tab 86 from its normally biassed position to impinge on the stem 84 of the valve assembly 78, and urging the valve actuation tab 86 to depress the stem 84 to its depressed position. Accordingly, it will now be understood that FIGS. 6 and 7 show that when the operator manipulable actuator 44 is engaged by the operator, throttle lever 50 is pulled into the cutting speed position. Additionally, it will be understood that the valve actuation tab 86 is preferably positioned between the stem 84 of the valve assembly 78 and the throttle lever 50, when the cutting fluid delivery controller 34 is operably attached to the sawmill 10, such that when moved to the cutting speed position, the throttle lever 50 contacts the valve actuation tab 86 and causes the valve actuation tab 86 to deflect from its initial position, and impinge on the stem 84, urging the stem 84 to be depressed to its depressed position, thereby allowing cutting fluid to flow through the valve assembly 78 to the blade 26. Preferably, when the valve actuation tab 86 is deflected, it is resiliently biassed away from the stem 84 toward its initial position by the compression spring 88.

What is important is that the cutting fluid delivery controller 34 is configured such that engaging the operator manipulable actuator 44 pulls the throttle lever 50 into the cutting speed position, which causes the stem 84 of the valve assembly 78 to depress, thereby allowing cutting fluid to flow through the valve assembly 78 to the blade 26. The provision of the valve actuation tab 86 between the stem 84 and the throttle lever 50 may be used to allow the stem 84 to be offset from the path of the throttle lever 50, and still be depressed by pulling the throttle lever 50 into the cutting speed position.

Accordingly, it is contemplated that the valve actuation tab 86 may be omitted entirely in other embodiments of the invention, for example where the path of throttle lever 50 aligns with the stem 84 such that pulling the throttle lever 50 to the cutting speed position is sufficient to depress the stem 84. It is also contemplated that the valve actuation tab 86 may be fixedly attached to, or integrally formed with, the throttle lever 50, such that the valve actuation tab 86 will strike the stem 84 to cause it to depress, when the throttle lever 50 is pulled to its cutting speed position. In some embodiments, an extension member (not shown) may also need to be attached to the throttle lever 50 to extend a length thereof. All such embodiments are comprehended by the present invention.

Figure 8:
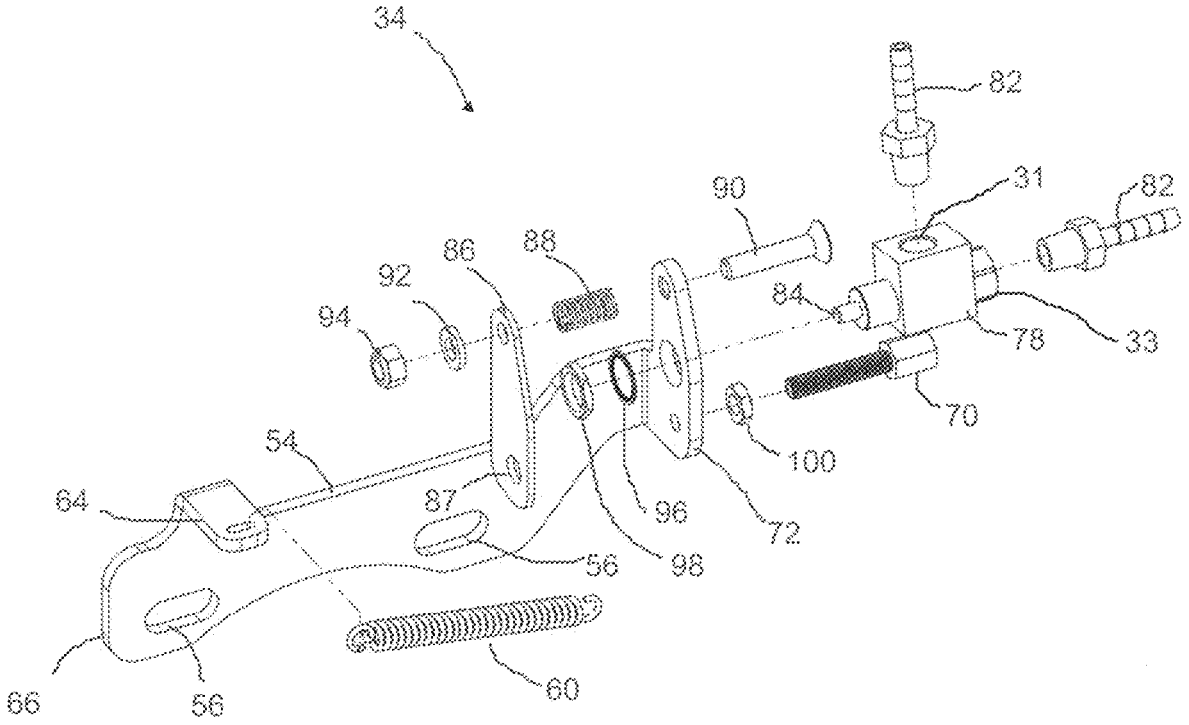
FIG. 8 is an exploded, rear view of the cutting fluid delivery controller of FIGS. 4 and 6.

FIG. 8 shows a rear view of the components of the preferred cutting fluid delivery controller 34, including the bracket 54, the apertures 56, the spring 60, the valve actuation tab 86, the flat head screw 90, the compression spring 88, the M6 washer 92, the M6 nut 94, the valve assembly 78, a ½ inch serrated washer 96, a thin nut 98, the barbed hose fittings 82, the cable thimble 70, and a M6 thin nut 100.

Figure 9:
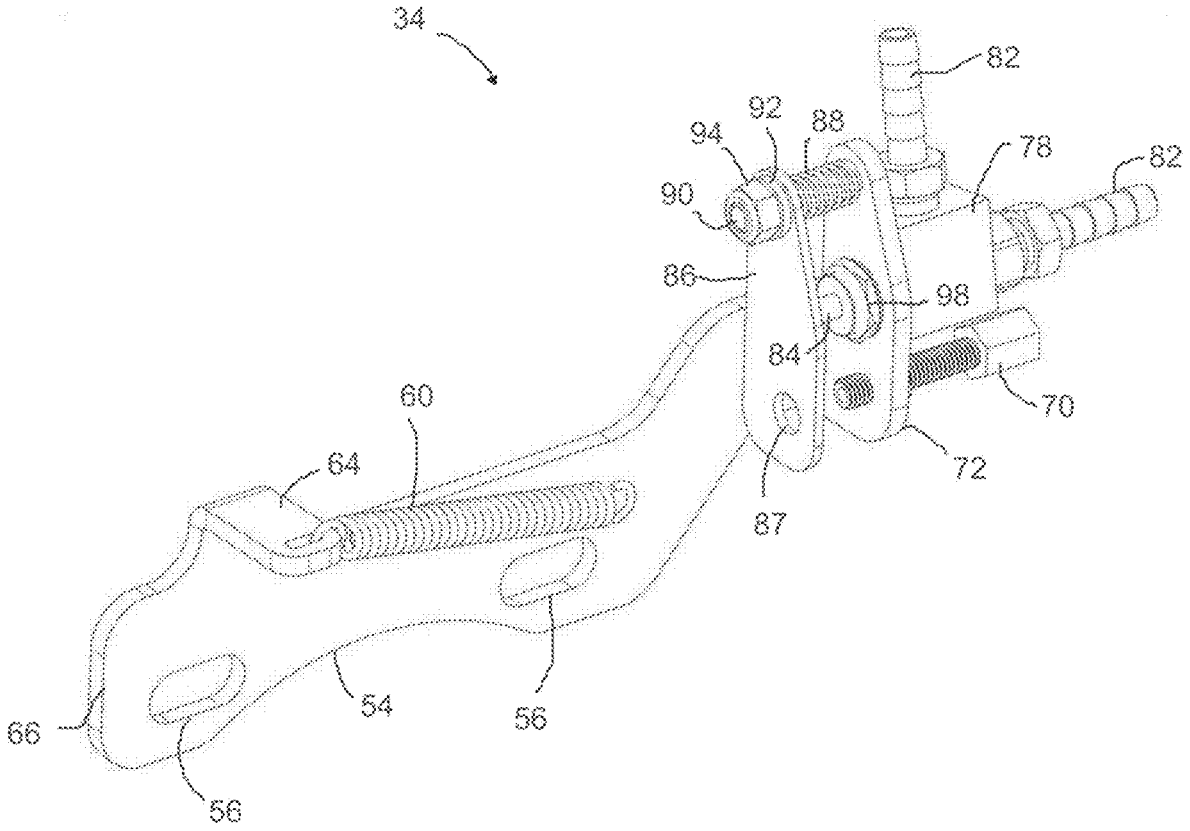
FIG. 9 is a perspective rear view of the cutting fluid delivery controller of FIG. 8 in an assembled state.

The components shown in FIG. 8 of the preferred cutting fluid delivery controller 34 are shown in FIG. 9 in an assembled state.

The cutting fluid delivery controller 34 may be provided in the form of a kit for assembly and attachment to a sawmill 10, or it may be provided preassembled and ready for installation in a sawmill 10. Furthermore, the cutting fluid delivery controller 34 may be provided with instructions for assembly and/or attachment to said sawmill 10. As another example, the cutting fluid delivery controller 34 may be provided as part of a throttle assembly 30, apart from the sawmill 10.

Advantageously, the cutting fluid delivery controller 34 may be used in methods of retrofitting a conventional sawmill to provide a sawmill 10 having a cutting fluid delivery system according to embodiments of the present invention. It will be appreciated that such methods may include providing and attaching to the conventional sawmill a cutting fluid reservoir 32, and an operator manipulable actuator 44, providing and attaching to the saw head of the conventional sawmill a cutting fluid discharge outlet 36, providing and attaching to the motor of the conventional sawmill a cutting fluid delivery controller 34, providing and attaching a conduit 38 between the cutting fluid reservoir 32 and the cutting fluid delivery controller 34, providing and attaching a conduit 38 between the cutting fluid delivery controller 34 and the cutting fluid discharge outlet 36, and providing and attaching a throttle link 46 between the operator manipulable actuator 44 and the cutting fluid delivery controller 34.

Also advantageous is the fact that embodiments of the present invention may provide one or more of the following benefits:

1) they may automatically deliver a lubricant to the blade 26 of the sawmill 10 when the operator manipulable actuator 44 is engaged, and conversely, they may automatically prevent delivery of lubricant to the blade 26 when the operator manipulable actuator 44 is disengaged, all without a secondary action from the operator;
2) they may provide a mounting location for the throttle lever 50 biassing spring 60; and
3) they may provide an attachment point, for example in the form of a cable thimble 70 attached to bracket 54, to securely hold the outer sheath 68 of the Bowden cable in place.

Also advantageous is the fact that embodiments of the present invention may provide auto lubrication of a blade 26 in a sawmill 10 wherein a single throttle link 46, such as a Bowden cable may be employed to simultaneously actuate the valve assembly 78 to commence delivery of the lubricant to the blade 26, and the throttle assembly to commence driving the blade 26. Furthermore, the ergonomic effort to depress the operator manipulable actuator 44 is not increased.

Also advantageous is the fact that the embodiments of the present invention may provide auto lubrication of a blade 26 in a sawmill 10 without requiring a source of electrical power to deliver the lubricant to the blade 26.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention, which invention is limited only by the appended claims.

The invention claimed is:

1. A cutting fluid delivery controller for controlling a flow of a cutting fluid from a cutting fluid reservoir to a saw blade in a sawmill, said sawmill being of the type having a motor for driving the saw blade, said motor comprising a throttle lever for regulating an operating speed of the motor, the throttle lever being movable between an idle speed position and a cutting speed position, said controller comprising:

a fluid valve having an inlet for receiving said cutting fluid, an outlet for discharging said cutting fluid for application to said saw blade, a fluid flow path between said inlet and said outlet, and a valve actuator having a first position which causes said fluid valve to block said fluid flow path, and a second position which causes said fluid valve to unblock said fluid flow path;

a frame member for holding said fluid valve, said frame member having an attachment member for attaching said frame member to said sawmill; and an operator manipulable actuator for moving the throttle lever between said idle speed position and said cutting speed position;

wherein when said cutting fluid delivery controller is operably attached to said sawmill, said valve actuator is directly, or indirectly moved from said first position to said second position by said throttle lever, when said throttle lever is moved to said cutting speed position, causing said fluid valve to allow said cutting fluid to flow from said inlet to said outlet toward said saw blade, and said valve actuator is moved back to said first position when said throttle lever is moved away from said cutting speed position, causing said fluid valve to prevent said cutting fluid from flowing from said inlet to said outlet toward said saw blade; and wherein said operator manipulable actuator is connected to said throttle lever by a throttle link, such that when an operator engages said operator manipulable actuator, said throttle link draws said throttle lever toward said valve actuator.

2. The cutting fluid delivery controller of claim 1, wherein said valve actuator is biased to said first position.

3. The cutting fluid delivery controller of claim 2, wherein said valve actuator is a depressible valve actuator;

wherein said first position is an extended position, and said second position is a depressed position; and wherein said extended position causes said fluid valve to block said fluid flow path, and said depressed position causes said fluid valve to unblock said fluid flow path.

4. The cutting fluid delivery controller of claim 3, further comprising a resiliently biassing member having one end attached to said throttle lever and another end attached to said frame member to resiliently bias said throttle lever away from said valve actuator.

5. The cutting fluid delivery controller of claim 3, wherein said frame member comprises a passageway positioned to allow said throttle link to pass through said frame member from said operator manipulable actuator to said throttle lever, wherein when said operator engages said operator manipulable actuator, said throttle link draws said throttle lever toward said valve actuator.

6. The cutting fluid delivery controller of claim 5, wherein said passageway in said frame member comprises an aperture.

7. The cutting fluid delivery controller of claim 5, wherein said passageway in said frame member comprises an adjustable guide.

8. The cutting fluid delivery controller of claim 7, wherein said adjustable guide comprises a threaded bore in said frame member, and a threaded cable thimble threadingly carried by said threaded bore;

wherein turning said cable thimble one way adjusts said adjustable guide in one of a first direction away from said threaded bore, and a second direction toward said threaded bore; and wherein turning said cable thimble the other way adjusts said adjustable cable guide in the other of said first direction and said second direction.

9. The cutting fluid delivery controller of claim 8, wherein said throttle link comprises an outer sheath housing an inner cable; and wherein said adjustable guide is sized and shaped to couple with said outer sheath, and allow said inner cable to pass through said adjustable guide for attachment to said throttle lever.

10. The cutting fluid delivery controller of claim 9, wherein said throttle link comprises a Bowden cable.

11. The cutting fluid delivery controller of claim 5, wherein said valve actuator is positioned in a path of said throttle lever defined between said idle speed position and said cutting speed position, such that when said cutting fluid controller is operably attached to said sawmill, said moving said throttle lever toward said cutting speed position will cause said throttle lever to directly, or indirectly depress said valve actuator toward said depressed position.

12. The cutting fluid delivery controller of claim 5, further comprising a valve actuation tab attached to said frame member, said valve actuation tab being sized, shaped, and positioned in a path of said throttle lever defined between said idle speed position and said cutting speed position, such that when said cutting fluid controller is operably attached to said sawmill, said moving said throttle lever toward said cutting speed position causes said throttle lever to directly, or indirectly depress said valve actuation tab to depress said valve actuator toward said depressed position.

13. The cutting fluid delivery controller of claim 12, wherein said valve actuation tab is positioned between said valve actuator and said throttle lever, when said cutting fluid delivery controller is operably attached to said sawmill.

14. The cutting fluid delivery controller of claim 13, wherein said valve actuation tab is one or both of a) pivotally attached to said frame member, and b) slidably attached to said frame member; and wherein said attachment of said valve actuation tab to said frame member is configured to allow said valve actuation tab to be deflected towards said valve actuator by said moving said throttle lever toward said cutting speed position when said cutting fluid delivery controller is operably attached to said sawmill.

15. The cutting fluid delivery controller of claim 14, wherein said attachment of said valve actuation tab to said frame member is resilient.

16. The cutting fluid delivery controller of claim 14, wherein said resilient attachment comprises:

a post having one end attached to said frame member, and the other end extending from said frame member, substantially parallel to said valve actuator; and a compression spring carried on said post;

wherein said valve actuation tab is attached to said post, with said compression spring located between said frame member and said valve actuation tab; and wherein said compression spring resiliently urges said valve actuation tab away from said valve actuator.

17. The cutting fluid delivery controller of claim 16, wherein said post is positioned above said valve actuator when said cutting fluid delivery controller is operably attached to said sawmill.

18. The cutting fluid delivery controller of claim 14, wherein said attachment of said valve actuation tab allows said valve actuation tab to one or more of a) pivot to and from said valve actuator in a first axis, b) pivot to and from said valve actuator in a second axes perpendicular to said first axis, and c) translocate to and from said valve actuator.

19. The cutting fluid delivery controller of claim 12, further comprising a passageway positioned on said valve actuation tab to allow said throttle link to pass through said valve actuation tab for attachment to said throttle lever.

20. The cutting fluid delivery controller of claim 19, wherein said passageway in said valve actuation tab is aligned with said passageway in said frame member, to allow said throttle link to pass through said passageway in said frame member and said passageway in said valve actuation tab to said throttle lever.

21. The cutting fluid delivery controller of claim 20, wherein said passageway in said valve actuation tab is an aperture.

22. The cutting fluid delivery controller of claim 1, wherein said throttle lever is one of a) pivotally movable between said idle speed position and said cutting speed position, and b) slidably movable between said idle speed position and said cutting speed position.

23. The cutting fluid delivery controller of claim 1, further comprising a first conduit attached to said inlet, wherein said first conduit is configured to fluidly connect said cutting fluid reservoir to said inlet.

24. The cutting fluid delivery controller of claim 1, wherein said cutting fluid reservoir is a public utility.

25. The cutting fluid delivery controller of claim 1, wherein said cutting fluid reservoir is a container.

26. The cutting fluid delivery controller of claim 25, wherein said container is attached to said sawmill.

27. The cutting fluid delivery controller of claim 1, wherein said motor is one of an internal combustion motor, and an electric motor.

28. The cutting fluid delivery controller of claim 1, further comprising:

a cutting fluid applicator configured for attachment to said sawmill for applying said cutting fluid onto said saw blade; and a second conduit attached to said outlet for fluidly connecting said outlet to said cutting fluid applicator.

29. The cutting fluid delivery controller of claim 28, wherein said cutting fluid applicator comprises one or both of a) a blade guide, and b) a spout.

30. The cutting fluid delivery controller of claim 1, in the form of a kit for assembly and attachment to a sawmill.

31. The cutting fluid delivery controller of claim 30, further comprising instructions for said assembly and said attachment to said sawmill.

32. The cutting fluid delivery controller of claim 1, wherein said frame member is attached to said motor of said sawmill.

33. A sawmill comprising the cutting fluid delivery controller as defined in claim 1.

34. A throttle assembly for a sawmill, said throttle assembly comprising the cutting fluid delivery controller as defined in claim 1.

35. A use of the cutting fluid delivery controller as defined in claim 1, in a sawmill to control said flow of said cutting fluid from said cutting fluid reservoir to said saw blade.

* * * * *